US005972455A

United States Patent [19]

Barry

[11] Patent Number: 5,972,455

[45] Date of Patent: Oct. 26, 1999

[54] SELF-ADHESIVE LABELS

[75] Inventor: David Robert Barry, St. Louis, Mo.

[73] Assignee: Inprint Systems Inc., St. Charles, Mo.

[21] Appl. No.: 08/963,710

[22] Filed: Nov. 4, 1997

Related U.S. Application Data

[63] Continuation of application No. 08/694,284, Aug. 8, 1996, Pat. No. 5,766,716.

[51] Int. Cl.[6] ..... G09F 3/02

[52] U.S. Cl. ..... 428/40.1; 281/2; 281/5; 283/81; 428/41.7; 428/41.8; 428/42.1; 428/42.2; 428/42.3; 428/43; 428/192; 428/194; 428/914

[58] Field of Search ..... 428/40.1, 41.7, 428/418, 42.1, 42.2, 42.3, 192, 194, 914, 43; 283/81; 281/2, 5

[56] References Cited

U.S. PATENT DOCUMENTS

| | | | |
|---|---|---|---|
| 4,621,442 | 11/1986 | Mack | 428/43 |
| 4,991,878 | 2/1991 | Cowan et al. | 283/81 |
| 5,021,273 | 6/1991 | Kobayashi | 428/40.1 |
| 5,200,243 | 4/1993 | Van Veen | 428/40.1 |
| 5,399,403 | 3/1995 | Instance | 428/40.1 |
| 5,403,636 | 4/1995 | Crum | 428/40.1 |
| 5,439,721 | 8/1995 | Pedroli | 428/40.1 |
| 5,587,222 | 12/1996 | Hoffmann | 428/192 |

FOREIGN PATENT DOCUMENTS

| | | |
|---|---|---|
| 0633555 | 1/1995 | European Pat. Off. . |
| 0650154 | 4/1995 | European Pat. Off. . |
| 2303351 | 2/1997 | United Kingdom . |

*Primary Examiner*—Nasser Ahmad

*Attorney, Agent, or Firm*—Rothwell, Figg, Ernst & Kurz, p.c.

[57] ABSTRACT

A self-adhesive label comprising a self-adhesive base carried on a backing of release material, a multilaminar portion disposed on a first portion of the base, a layer of adhesive on a second portion of the base adjacent to the first portion, and a printed cover sheet having a first edge portion which is adhered to the base by the layer of adhesive, a central portion which extends over the multilaminar label, and a second edge portion opposite to the first edge portion which is arranged to be held against the backing of release material thereby to retain the self-adhesive label in a closed configuration.

8 Claims, 4 Drawing Sheets

SELF-ADHESIVE LABELS

This is a continuation of application Ser. No. 08/694,284 filed Aug. 8, 1996 now U.S. Pat. No. 5,766,716.

BACKGROUND TO THE INVENTION

The present invention relates to self-adhesive labels. In particular, the present invention relates to self-adhesive labels of multi-laminar construction in which the label incorporates a booklet or folded sheet so as to provide a large surface area for carrying printed information which is greater than the surface area of the footprint of the label. The labels of the present invention have particular application in the labelling of pharmaceutical products.

A variety of so-called leaflet labels or booklet labels are known in the art and a typical label construction is disclosed in U.S. Pat. No. 5,399,403 in the name of David J Instance. In such labels, an individual folded leaflet or booklet is carried on a self-adhesive base or support piece which itself is releasably adhered to a backing of release material The folded leaflet or booklet is often overlaminated with a self-adhesive transparent plastics layer.

Such labels can be relatively expensive to manufacture because of the need to print substantially all of the text, apart from that on the base by multi-colour printing on a single sheet of relatively expensive coated paper to be subsequently folded or formed into a booklet or leaflet. Furthermore, the known labels can suffer from the disadvantage that when several versions of the same label construction corresponding to slight variations in the product to be labelled are required, it is necessary to have a separate sheet printed for each version of the label. This is relatively inefficient to manufacture, particularly for short manufacturing runs for the labels, because this requires the folded leaflet or booklet parts to be manufactured to order or held in stock for each label version Finally, such labels are employed to label pharmaceutical products. In order to protect consumers of pharmaceutical products. It is essential that proper quality control is exercised to ensure that the correct folded leaflet or booklet is married up with the correct underlying base support piece.

The present invention aims to provide improved self-adhesive labels.

More particularly, it is an object of the present invention to provide lower cost leaflet labels or booklet labels. particularly for short run multiple brand name versions of the same label.

It is a further object of the present invention to provide a multi-component leaflet label having improved quality control features to ensure correct manufacture.

SUMMARY OF THE INVENTION

The present invention provides a self-adhesive label comprising a self-adhesive base carried on a backing of release material, a multilaminar portion disposed on a first portion of the base, a layer of adhesive on a second portion of the base adjacent to the first portion, and a printed cover sheet having a first edge portion which is adhered to the base by the layer of adhesive, a central portion which extends over the multilaminar portion, and a second edge portion opposite to the first edge portion which is arranged to be held against the backing of release material thereby to retain the self-adhesive label in a closed configuration.

The present invention further provides a multi-component self-adhesive label carried on a backing of release material, the label comprising a self-adhesive base having a rearwardly-directed self-adhesive surface releasably adhered to the backing of release material and a printed upper surface, a multilaminar portion selected from the group consisting of a booklet and a folded leaflet, the multilaminar portion being disposed on the upper surface of the base, a printed cover which is adhered by a first edge portion thereof to an edge portion of the upper surface of the base at a first side of the label, covers an upper surface of the multilaminar portion and, at a second side of the label opposite to the first side, extends past both the base and the multilaminar portion to form a second edge portion thereof which is secured to the backing of release material, the upper surface of the base and at least one surface of the cover being printed by a web printing process.

The present invention yet further provides a multi-component self-adhesive label carried on a backing of release material, the label comprising as a first component a self-adhesive printed base adhered by a self-adhesive rear surface thereof to the backing of release material, as a second component a folded printed multilaminar portion positioned on the base and as a third component a printed cover for the multilaminar portion which has one edge adhered to the base and a second edge secured to the release material adjacent the base on respective opposed sides of the multilaminar portion whereby the label is adhered in a closed configuration and is openable by pulling the second edge away from the release material, and wherein at least one of the base and the multilaminar portion is provided with a printed code which can be inspected when the label is in the closed configuration.

The present invention still further provides a self-adhesive label carried on a backing of release material comprising a multilaminar portion, a cover having a central portion which covers the multilaminar portion and first and second opposed edge portions on respective opposed sides of the multilaminar portion, the edge portions being adhered to a backing of release material and the multilaminar portion being adhered to the central portion, and first and second tear lines separating the central portion from the respective edge portions, whereby the central portion and the multilaminar portion adhered thereto can be pulled away from the remainder of the label by tearing along the tear lines.

BRIEF DESCRIPTION OF THE DRAWINGS

Embodiments of the present invention will now be described, by way of example only, with reference to the accompanying drawings, in which.

DETAILED DESCRIPTION OF THE PREFERRED EMBODIMENTS

Figure 1:
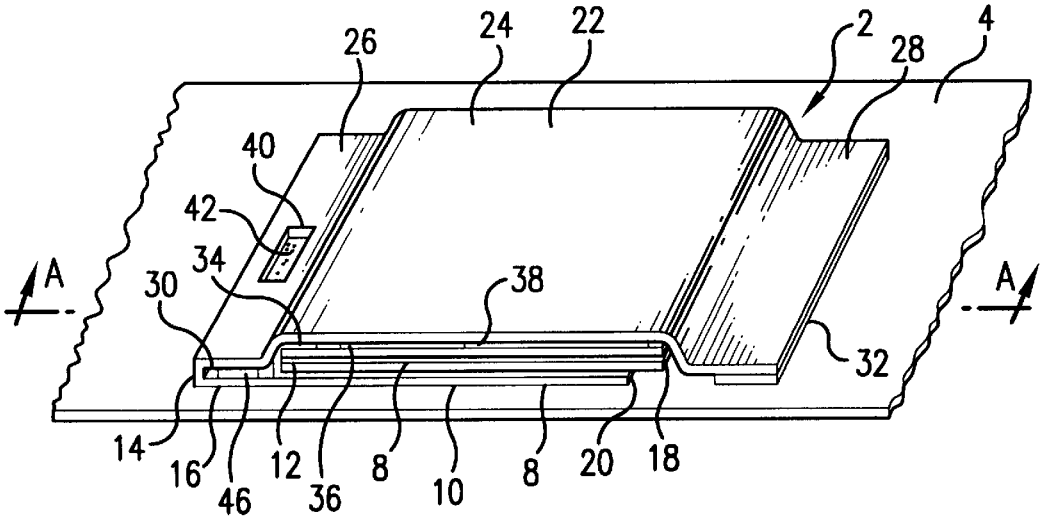
FIG. 1 is a perspective plan view of a self-adhesive label carried on a backing of release material in accordance with a first embodiment of the present invention.

In the drawings, the thickness of some of the layers has been exaggerated for the purpose of clarity of illustration.

Referring to FIG. 1, there is shown a self-adhesive label 2 in accordance with a first embodiment of the present invention when carried on a backing 4 of release material. Typically, a succession of such self-adhesive labels is carried on an elongate web of the backing 4 of release material and the backing 4 of release material is wound into a reel in known manner for automatic application of the labels to a succession of products or containers to be labelled by a labelling machine.

The self-adhesive label 2 comprises a self-adhesive base 6, typically of paper or plastics, which is coated on its rear surface with a layer of pressure-sensitive adhesive which is releasably adhered to the backing 4 of release material. A booklet 8 is disposed over a major portion 10 of the base 6 with a spine 12 of the booklet being spaced from a transverse edge 14 of the base 6 so as not to cover a minor edge portion 16 of the base 6. The edge 18 of the booklet 8 which is opposite to the spine 12 extends longitudinally past an opposed transverse edge 20 of the base 6. However, in an alternative embodiment the edge 18 may stop short of or coincide with the transverse edge 20. A cover 22 has a central portion 24 which covers the booklet 8 and two opposed edge portions 26,28. One edge portion 26 is adhered by a layer of adhesive 30 to the minor edge portion 16 of the base 6 and the other edge portion 28 is adhered by a second layer of adhesive 32 directly to the backing 4 of release material. A third layer of adhesive 34 is located between an upper surface 36 of the booklet 8 and a lower surface 38 of the cover 22 along the length of the spine 12 of the booklet 8.

In the illustrated embodiment, the first and third adhesive layers 30,34 are comprised of a permanent adhesive, typically a water-soluble adhesive such as a PVA adhesive or a hot-melt adhesive, which adheres together the base 6, the booklet 8 and the cover 22. The second layer 32 of adhesive in the illustrated embodiment comprises a resealable adhesive, such as a hot-melt resealable adhesive, which is intended to be releasably adhered to the intended product to be labelled. Thus when the self-adhesive label 2 is adhered to a product to be labelled, for example a pharmaceutical container, the label 2 may be opened so as to access the booklet 8 by pulling away the edge portion 28 of the cover 22 from the product. In an alternative arrangement the second layer 32 of adhesive is a permanent adhesive and one or more perforation lines (not shown) is provided through the cover 22 between the second layer 32 of adhesive and the booklet 8, which perforation line or lines may be torn when the label 2 is adhered to a product thereby to access the booklet 8. In a further alternative arrangement, the major and minor portions of the base are interchanged whereby the booklet is disposed over the minor portion of the base and the cover sheet is adhered to a major portion of the base.

Figure 2:
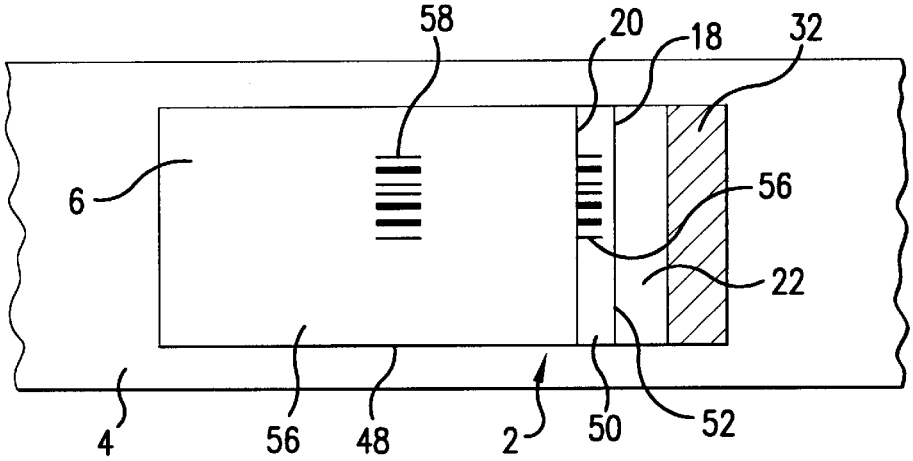
FIG. 2 is a view from below of the label of FIG. 1, the rear surface of the label being viewed through the transparent backing of release material.

In accordance with a particularly preferred aspect of the present invention, the self-adhesive label is provided with a number of security features to enable the integrity of the label to be checked. When pharmaceutical products are labelled it is essential, in order to minimize product liability exposure of the manufacturer for the label to be correctly manufactured. In multi-component labels it is essential that the label as a whole combines the correct components. In accordance with this aspect of the present invention, a cut out hole 40 forming a window in the cover 22 may be provided through the edge portion 26 of the cover 22 which exposes a code 42 printed on the upper surface 44 of the base 6. In this way, a user or purchaser of the self-adhesive label 2 can verify that the self-adhesive label 2 incorporates the correct base 6. Furthermore, as shown in FIG. 2, the backing 4 of release material is composed of a transparent plastics web. Accordingly, the rear surface 48 of the self-adhesive label 2 can readily be inspected either visually or automatically. The provision of the edge 18 of the booklet 8 extending past the transverse edge 20 of the base 6 reveals an exposed portion 50 of the rear-most sheet 52 of the booklet 8. The exposed surface 50 and the rear surface 54 of the self-adhesive base 6 may each be printed with a respective code 56,58, in the illustrated embodiment the codes 56,58 being bar codes. The bar codes 56,58 can be scanned either visually or automatically to ensure that the correct booklet 8 is married with the correct base 6.

Figure 3:
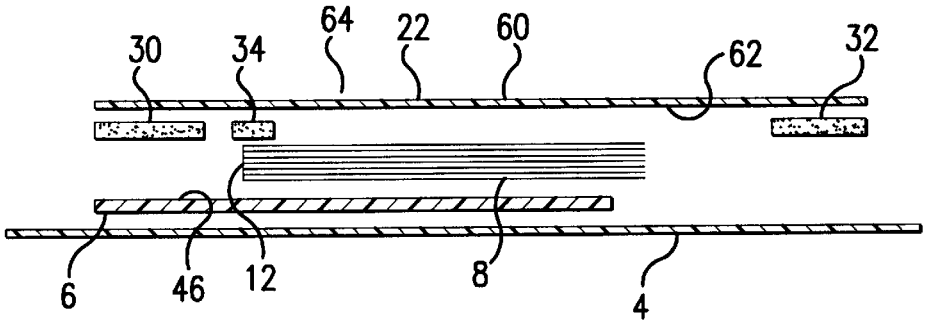
FIG. 3 is an exploded section along line A—A of the label of FIG. 1.

Referring to FIG. 3, the various components of the self-adhesive label 2 are shown in an exploded manner. The self-adhesive base 6 is releasably adhered to the backing 4 of release material. A succession of the self-adhesive bases 6 may be formed on a length of the backing 4 of release material by providing a web of conventional labelstock material comprising a self-adhesive web carried on a backing of release material, printing a succession of images on the upper surface of the self-adhesive web, die-cutting the self-adhesive web to form a succession of labels carried on the backing of release material and then removing the matrix of waste material surrounding the labels. Following such a process, the bases 6 may be provided with a desired printed image on the upper surface 46 of each base 6. Each booklet 8 comprises a plurality of printed sheets and has been applied to a respective base 6. The cover sheet 22 may be composed of any suitable material, such as paper or plastics. Both the front surface 60 and the rear surface 62 of the cover 22 may be printed with desired images. A printed web to form the cover sheets is adhered by the adhesive layers over the booklet/base assemblies. The resultant web is die-cut to form the required labels and the waste web matrix is removed. In one particular arrangement, the cover 22 may be transparent plastics, optionally printed on one or both surfaces thereof. In such an arrangement, there is no need to die cut a window through the cover 22 such as window 40 in FIG. 1. Instead the underlying code 42 can simply be revealed through the transparent cover, optionally through an unprinted window formed by the printing therearound of a solid opaque layer on the top or rear surface of the cover.

The front surface 64 of the self-adhesive label 2 essentially comprises the printed front surface 60 of the cover 22. Thus in accordance with the present invention it is possible for only the cover 22 to be printed with high quality multi-colour images by a web printing process, e.g. by flexography. The high quality multi-colour images may also be printed on the upper surface 46 of the base 6 by a web printing process such as flexography. The remainder of the label 2, comprising the booklet 8 as the major printed portion of the label 2, may be printed with lower quality single colour printing and a lower quality paper without detracting from the overall initial appearance of the label.

This can lead to a reduction in cost of the label 2. The booklet may have been printed as a sheet or sheets and then folded and formed into a booklet.

Furthermore, when the label 2 is intended to be printed in a number of different slightly varying versions, for example when the label 2 is intended to label a range of pharmaceutical products, the front surface of the base and the front surface of the cover may be printed with version-specific information such as information concerning the tablet count and dosage for the particular pharmaceutical product, and the booklet can be printed with common information for each version of the label. Thus for a number of versions of the label, only a single printed booklet may be required. This increases the efficiency of production of the label.

The multi-component structure of the label consisting of the cover, which may be printed on its front and rear surfaces, the booklet, and the base, which may be printed on its front surface, can effectively simulate a multi-page booklet having a greater number of pages than the actual booklet disposed over the base label. Thus in the resultant label, the label can simulate the printed area of for example a twelve page booklet adhered to the product whereas the booklet itself only has eight pages. This enables thinner booklets to be employed thereby making the booklet easier to fold and manufacture and, for the product manufacturer who applies the labels automatically on a packaging line, easier to use.

The label, in this and other embodiments, may be modified by employing a folded sheet or leaflet rather than a booklet. The third adhesive layer may be located between the base and the rearmost sheet of the booklet. The printing on the base and on the cover sheet may be cured using UV radiation. In additions the printing on the cover sheet may be overcoated with a varnish layer to provide scuff resistance for the label. One or more openings may be left in the varnished layer to permit overprinting on the cover sheet by hot-stamping, laser printing, or thermal transfer. In addition, the bases may comprise a continuous integral base for each label rather than first and second base portions for each label.

Figure 4:
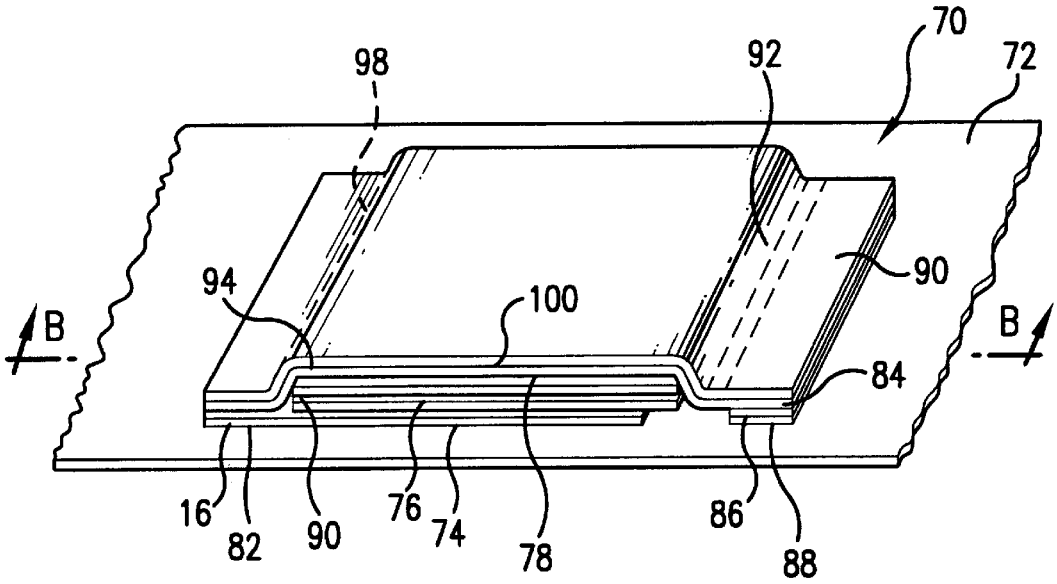
FIG. 4 is a perspective plan view of a self-adhesive label carried on a backing of release material in accordance with a second embodiment of the present invention.
Figure 5:
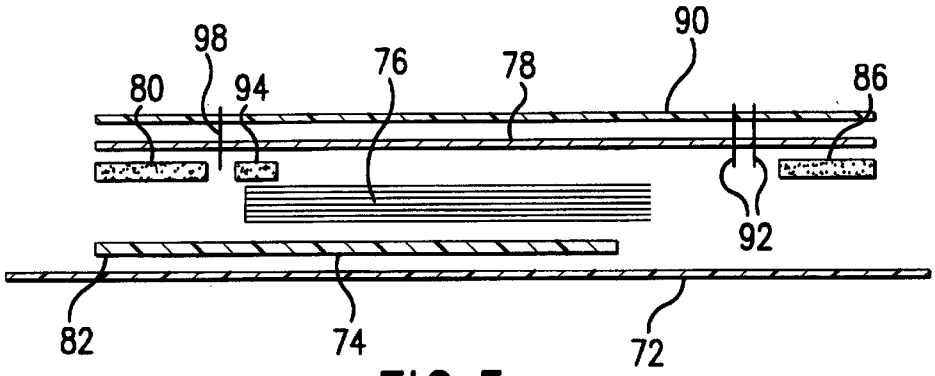
FIG. 5 is an exploded section along line B—B of the label of FIG. 4.

Referring to FIGS. 4 and 5 there is shown in a second embodiment of a self-adhesive label 70 carried on a backing 72 of release material in accordance with the present invention. In this embodiment, a self-adhesive base 74 has disposed thereover a booklet 76 and a cover 78 is adhered by a layer of adhesive 80 to one transverse edge 82 of the base, extends over the booklet 76 and is adhered to the backing 72 of release material as in the first embodiment. In this embodiment, the transverse edge 84 of the cover 78 is adhered via a second layer 86 of adhesive to a self-adhesive transverse support strip 88 comprised of the same material as that of the base 74. The entire label 70 is overlaminated with a transparent self-adhesive plastics laminar material 90 which protects the label against inadvertent damage and enhances the aesthetic appearance of the label. A pair of perforation lines 92 extend through the laminar material 90 and the cover 78 at a position located inwardly of the second adhesive layer 86. When the label 70 is adhered to a product and is desired to be opened by a user, the booklet 76 can be accessed by tearing along the perforation lines 92. A third layer 94 of adhesive adheres the booklet 76 in the vicinity of the spine 98 to the cover 78. A further perforation line 98 extends through the laminar material 90 and the cover 78 and is positioned between the second and third layers 80,94 of adhesive. The perforation line 98 may extend through base also. After a user has opened the label by tearing along the perforation lines 92, the central portion 100 of the cover 78 and the underlying booklet 76 adhered thereto can be removed from the underlying base 74 by tearing along the perforation line 98.

The self-adhesive label of FIGS. 4 and 5 may be modified by the omission of the plastics laminar material.

Figure 6:
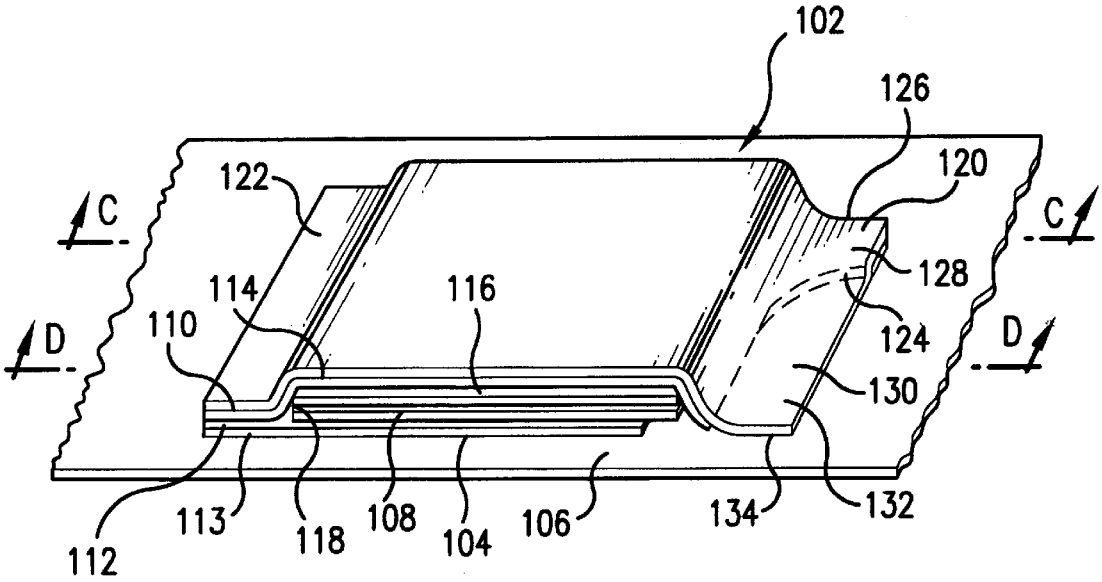
FIG. 6 is a perspective plan view of a self-adhesive label carried on a backing of release material in accordance with a third embodiment of the present invention.
Figure 7:
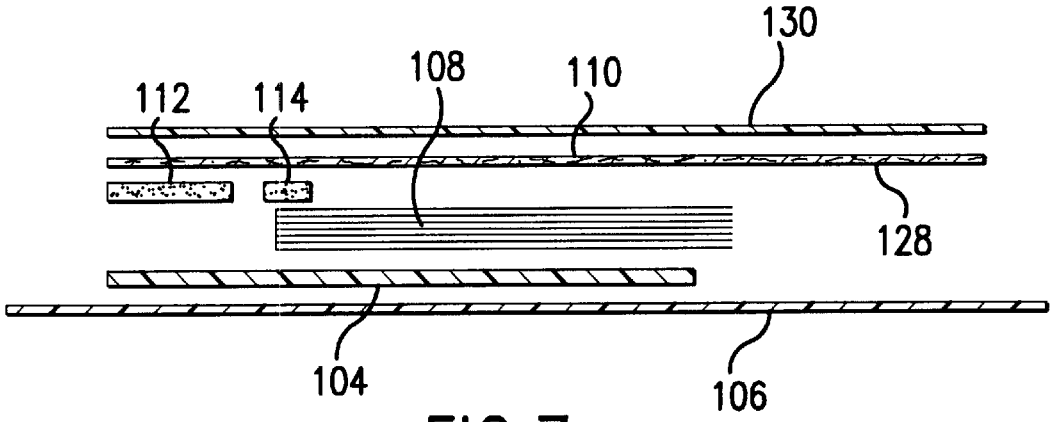
FIG. 7 is an exploded section along line C—C of the label of FIG. 6.
Figure 8:
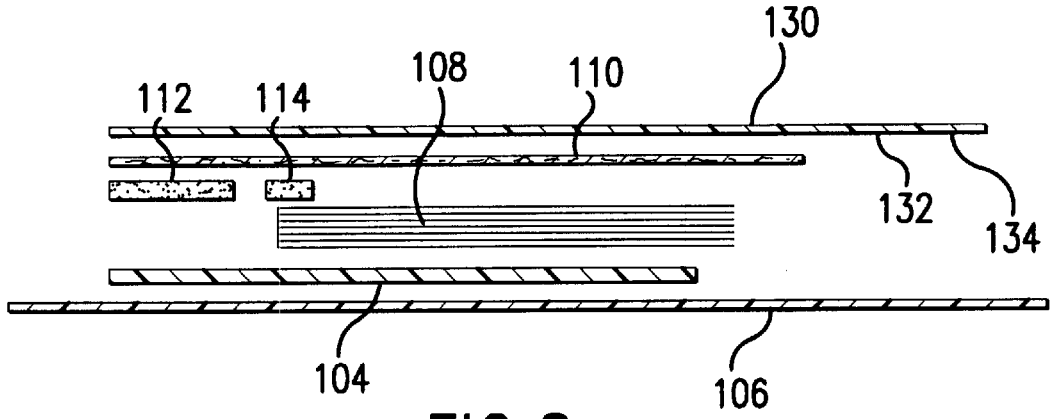
FIG. 8 is an exploded section along line D—D of the label of FIG. 6.

FIGS. 6 to 8 illustrate a label in accordance with a third embodiment of the present invention.

In this embodiment, the label of the second embodiment is modified by omission of the second adhesive layer and the underlying self-adhesive support piece and by die-cutting the free transverse edge of the cover sheet so as to provide a peel-up tab and adjacent thereto a rearwardly-exposed self-adhesive surface of the laminar material which is adhered directly to the backing of release material thereby to hold the label in a closed configuration. The resultant label is resealable and the perforation lines may be omitted.

More particularly, the self-adhesive label 102 comprises a self-adhesive base 104 carried on a backing 106 of release material. A booklet 108 is disposed over the base 104 and a cover sheet 110 is adhered by a first layer of adhesive 112 to a transverse edge 113 of the base 104 and by a second layer 114 of adhesive to an upper surface 116 of the booklet 108 along the spine 118 of the booklet 108. The cover sheet 110 is provided at its free transverse edge 120 opposite to the other transverse edge 122 which is adhered to the base 104 with a die-cut edge 124. The die-cut edge 124 defines at one longitudinal edge 126 of the label 102 a peel-up tab 128. A transparent self-adhesive plastics laminar material 130 is adhered by its self-adhesive surface over the cover sheet 110. The laminar material 130 extends past the die-cut edge 124 of the cover sheet 110 at a location transversely adjacent to the peel-up tab 128 to form an edge portion 132 thereof which has a rearwardly-exposed self-adhesive surface 134 which is adhered directly to the backing 106 of release material. When the label 102 is adhered to a product, a user may manually pull the peel-up tab 128 thereby pulling the edge portion 132 of the laminar material 130 away from the product so as to open the label 102. After the booklet 108 has been read by the user, the label 102 may be returned into its closed configuration by re-adhering the edge portion 132 of the laminar material 130 back onto the product surface.

Figure 9:
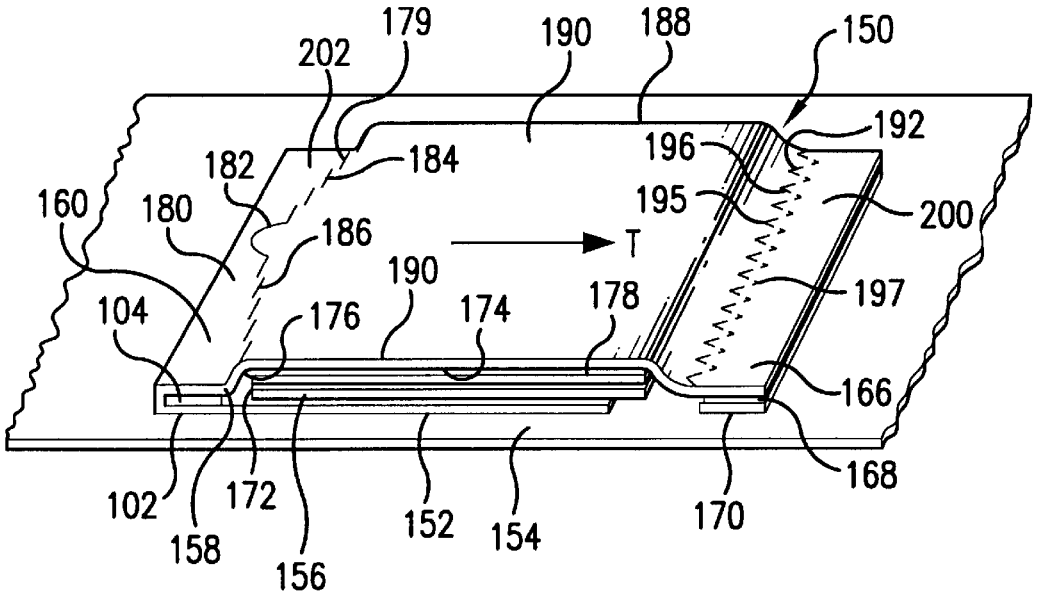
FIG. 9 is a perspective plan view of a self-adhesive label carried on a backing of release material in accordance with a fourth embodiment of the present invention.
Figure 10:
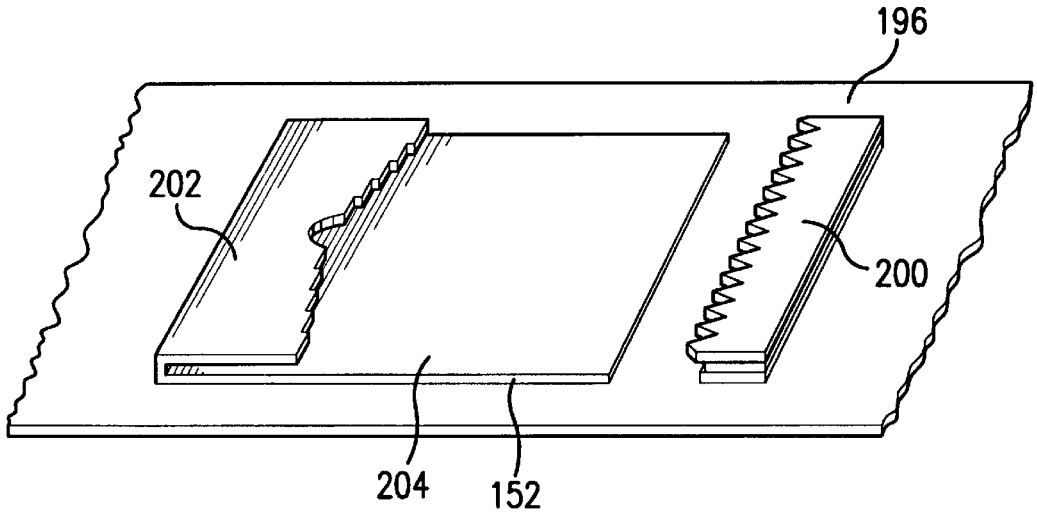
FIG. 10 is a perspective plan view of the label if FIG. 9 following removal of the booklet therefrom.

A further embodiment of a self-adhesive label in accordance with the present invention is illustrated in FIGS. 9 and 10. In this embodiment, the self-adhesive label 150 is specifically configured for use as a label for labelling pharmaceutical products in which a drug, for example an antibiotic, is supplied in a container labelled with the label 150, to a pharmacist. The pharmacist employs a portion of the label to assist the pharmacist in dispensing the drug, that portion of the label is removed by the pharmacist and then the container for the drug, with the remaining portions of the labelled adhered thereto, is given to the patient to whom the drug has been prescribed.

As shown in FIG. 9, the self-adhesive label 150 comprises a self-adhesive base 152 which is carried on a backing 154 of release material. As in the embodiment of FIG. 1, a booklet 156 is disposed over the base 152 and a cover 158 is in turn disposed over the booklet 156. One edge 160 of the cover 158 is adhered to a corresponding edge 182 of the base 152 by a first layer 164 of adhesive and an opposing edge 166 of the cover 158 is adhered by a second layer 168 of adhesive to a second base 170 which is separated from the first-mentioned base 152. In alternative configurations, the base 152 and the second base 170 are integral or the second base 170 is omitted. The spine 172 of the booklet 156 is adhered to the rearwardly-directed surface 174 of the cover 158 by a third layer 176 of adhesive which is located along the spine 172 on the top sheet 178 of the booklet 156. The layers 164,176 of adhesive are spaced in the longitudinal direction of the backing 154 of release material and located therebetween is a substantially V-shaped tear line 179. The layer 164 substantially covers the whole rear surface of the edge 160, or alternatively adhesive spots are provided between the tear line 179 and a linear band of adhesive 164. The tear line 179 diverges outwardly from a transversely centrally located portion 180 of the cover 158. The tear line 179 is provided with a central tab part 182 and a pair of inclined cascading tear lines 184,186 extending from the central portion 180, towards respective longitudinal edges 188,190 of the cover 158. A further tear line 192 is provided in the cover 158 between the booklet 156 and the second layer 168 of adhesive. The second tear line 192 comprises a series of V-shaped cuts 194 extending in a line transversely across the cover 158, with the apexes 195 of the V-shaped cuts 194 pointing away from the second layer 168 of adhesive, and a series of linear cuts 197 adjacent the second layer 168 of adhesive.

As shown in FIG. 10, in use, the label 150 is adhered to a product 196 to be labelled. When the product 196 is a container for a pharmaceutical for dispensing by a pharmacist, the pharmacist can pull the booklet 156 and the central portion 198 of the cover 158 adhered thereto by the layer 176 of adhesive by pulling manually the tab 182 in a left to right direction in FIG. 9, the tear-off direction being shown by arrow T. This causes the tear line 179 to be separated along the cascading tear line portions 184,186 when the tab 182 is pulled further. After tearing along the tear line 179, the booklet 156 is pulled away from the base 152 and is then completely removed from the base by tearing along the tear line 192. The V-shaped cuts 194 of the tear line 192 ensure that the booklet 156 and its overlying central portion 198 of the cover 158 are completely removed and severed from the edge portion 200 of the cover 158 which in FIGS. 9 and 10 is located on the right-hand side of the tear line 192. After the booklet 156 has been removed, the portion 200 of the cover 158 and an opposed portion 202 of the cover 158 remain adhered to the product 196. As shown in FIG. 10 any information which has been originally printed on either or both of the portions 200, 202 of the cover 158 remain in the self-adhesive label 150 and thus on the product 196 after removing of the booklet 156 and the overlying central portion 198 of the cover 158. The central part 204 of the base 152 which has been revealed is also printed with information, typically information which was printed on the now-removed central portion 198 of the cover 158.

The self-adhesive label 150 illustrated in FIGS. 9 and 10 differ substantially from prior self-adhesive multilaminar labels in that a multilaminar portion, in the illustrated embodiment represented by a booklet, is removably held in the label and can be removed from the remainder of the label by tearing along a tear line adjacent the spine of the booklet The tearing direction is from the spine of the booklet towards an opposed edge of the booklet. In the illustrated embodiment, the tear line 179 is located between the two adhesive layers 164,176 whereby the tear line 179 can readily be manually torn by a user in a direction from left to right in FIGS. 9 and 10. The booklet and the associated central portion 198 of the cover 158 are pulled away from the self-adhesive base 152 and are entirely separated from the remainder of the label by tearing along the second tear line 192. The tear lines 179,192 in the cover 158 are located so that, as shown in FIG. 10, following removal of the booklet 156, the cover sheet 158 has two opposed end portions 200,202 thereof which may contain overprinted information, such as information relating to the lot or batch number and expiry date of the, pharmaceutical product, which is required to be present on the label following the dispensing of the pharmaceutical product by the pharmacist.

The embodiment of FIGS. 9 and 10 may be modified for example by the use of a folded leaflet instead of a booklet and/or by the addition of a plastics overlaminate.

It will be appreciated that the security and coding features disclosed with respect to the first embodiment may be incorporated into each of the other embodiments.

What is claimed is:

1. A self-adhesive label carried on a backing of release material comprising a multilaminar portion, a cover having a central portion which covers the multilaminar portion and first and second opposed edge portions on respective opposed sides of the multilaminar portion, the edge portions being adhered to a backing of release material and the multilaminar portion being adhered to the central portion and first and second tear lines separating the central portion from the respective edge portions, whereby the central portion and the multilaminar portion adhered thereto can be pulled away from the remainder of the label by tearing along the tear lines, wherein the first and second tear lines are configured to define a tear-off direction therebetween, in which direction the central portion having the multilaminar portion adhered thereto is adapted to be pulled to remove the multilaminar portion from the label.

2. A self-adhesive label according to claim 1 wherein at least one of the first and second edge portions is adhered to a self-adhesive base which is releasably adhered to the backing of release material.

3. A self-adhesive label according to claim 2 wherein the self-adhesive base comprises first and second base portions to which the first and second edge portions are respectively adhered.

4. A self-adhesive label according to claim 1 wherein the first tear line is substantially V-shaped and diverges in the said tear-off direction.

5. A self-adhesive label according to claim 1 wherein the central portion is adhered to an upper panel of the multilaminar portion substantially adjacent the first tear line.

6. A self-adhesive label according to claim 1 wherein the multilaminar portion is a booklet.

7. A self-adhesive label according to claim 5 wherein the multilaminar portion is a booklet and a portion of the upper panel adjacent a spine of the booklet is adhered to the central portion.

8. A self-adhesive label according to claim 1, wherein the first tear line is located adjacent the first edge portion and the second tear line is located adjacent the second edge portion.

* * * * *